US008223182B2

(12) United States Patent
Komatsu

(10) Patent No.: US 8,223,182 B2
(45) Date of Patent: Jul. 17, 2012

(54) PRINTER AND METHOD OF DETERMINING PRINT START POSITION

(75) Inventor: Tadahiro Komatsu, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 281 days.

(21) Appl. No.: 12/763,345

(22) Filed: Apr. 20, 2010

(65) Prior Publication Data

US 2011/0063398 A1 Mar. 17, 2011

(30) Foreign Application Priority Data

Sep. 16, 2009 (JP) ..... 2009-214647

(51) Int. Cl.
*B41J 2/32* (2006.01)

(52) U.S. Cl. ..... 347/218

(58) Field of Classification Search ..... 347/218, 347/101, 104
See application file for complete search history.

(56) References Cited

U.S. PATENT DOCUMENTS

2010/0032466 A1* 2/2010 Nishimura et al. ..... 226/1

FOREIGN PATENT DOCUMENTS

| | | |
|---|---|---|
| JP | 62-153045 | 7/1987 |
| JP | 62-251333 | 11/1987 |
| JP | 05-246414 | 9/1993 |
| JP | 08-300740 | 11/1996 |
| JP | 2002-200806 | 7/2002 |
| JP | 2006-205530 | 8/2006 |
| JP | 2009-078454 | 4/2009 |
| JP | 2010-036507 | 2/2010 |

OTHER PUBLICATIONS

Machine-generated translation of JP 2002-200806, published on Jul. 2002.*

Japanese Office Action for Japanese Application No. 2009-214647 mailed on Dec. 13, 2011.

* cited by examiner

*Primary Examiner* — Huan Tran
(74) *Attorney, Agent, or Firm* — Turocy & Watson, LLP

(57) ABSTRACT

A printer includes: a nonvolatile storage section configured to be capable of keeping stored content even if a power supply is turned off; a sheet storing section configured to store a label sheet wound in a roll shape; a thermal head configured to heat a label stuck to a base sheet of the label sheet and perform printing in a process in which the label sheet, which is stored in the sheet storing section, is drawn out and conveyed in a sub-scanning direction by using a motor as a driving source; a label-position detecting section provided in a sheet conveying path, which connects between the position of the sheet storing section and the position where the thermal head is arranged, and configured to detect a label position of the label sheet; an information storing section configured to store a position of the label sheet detected by the label-position detecting section when the power supply is turned off in the nonvolatile storage section as stop position information; and a position setting section configured to set the stop position information, which is stored in the nonvolatile storage section, as a print start position for printing by the thermal head.

11 Claims, 5 Drawing Sheets

PRINTER AND METHOD OF DETERMINING PRINT START POSITION

CROSS-REFERENCE TO RELATED APPLICATION

This application claims the benefit of priority from Japanese Patent Application No. 2009-214647 filed on Sep. 16, 2009, the entire content of which is incorporated herein by reference.

TECHNICAL FIELD

The present invention relates to a printer and a method of determining a print start position.

BACKGROUND

Portable printers are widely used in various applications such as home delivery services and inventory management. A portable printer is disclosed in, for example, JP-A-08-300740 (Document 1). As one of forms of use, the portable printer disclosed in Document 1 stores a label sheet attached with a base sheet wound in a roll shape, applies printing based on accumulated print data to labels stuck to the base sheet while drawing out the label sheet, peels off a printed label from the base sheet, and issues the label from an issue port.

In the past, the portable printer of this type determines a print start position by feeding the label sheet by a distance equivalent to one label when a power supply is turned on. This is because, in the portable printer of this type, since a stop position of the label sheet (i.e., a print start position at the time of power-on) is unknown when the power supply is turned off, a shift often occurs in a print position if printing is started in that state when the power supply is turned on.

However, it is extremely wasteful to feed the label sheet by the distance equivalent to one label every time the power supply is turned on. In particular, in the portable printer used in the home delivery services and the like, since the power supply tends to be turned on and off many times, the number of wasted labels tends to increase.

It is also conceivable to determine the print start position by back-feeding the label sheet and then feeding the label sheet by the distance equivalent to one label when the power supply is turned on. However, for example, when the length of the short side of the label stuck to the base sheet of the label sheet is small, the label comes off the base sheet according to the back-feed and a jam occurs.

The present invention has been devised in view of the above and it is an object of the present invention to provide a printer and a method of determining a print start position with which labels stuck to a base sheet of a label sheet are not wasted when a print start position is determined compared with the portable printer in the past that always feeds the label sheet by the distance equivalent to one label in order to determine a print start position.

SUMMARY

According to an aspect of the present invention, there is provided a printer including: a nonvolatile storage section configured to be capable of keeping stored content even if a power supply is turned off; a sheet storing section configured to store a label sheet wound in a roll shape; a thermal head configured to heat a label stuck to a base sheet of the label sheet and perform printing in a process in which the label sheet, which is stored in the sheet storing section, is drawn out and conveyed in a sub-scanning direction by using a motor as a driving source; a label-position detecting section provided in a sheet conveying path, which connects between the position of the sheet storing section and the position where the thermal head is arranged, and configured to detect a label position of the label sheet; an information storing section configured to store a position of the label sheet detected by the label-position detecting section when the power supply is turned off in the nonvolatile storage section as stop position information; and a position setting section configured to set the stop position information, which is stored in the nonvolatile storage section, as a print start position for printing by the thermal head.

According to another aspect of the present invention, there is provided a method of determining a print start position executed by a printer including: a nonvolatile storage section configured to be capable of keeping stored content even if a power supply is turned off; a sheet storing section configured to store a label sheet wound in a roll shape; a thermal head configured to heat a label stuck to a base sheet of the label sheet and perform printing in a process in which the label sheet, which is stored in the sheet storing section, is drawn out and conveyed in a sub-scanning direction by using a motor as a driving source; and a label-position detecting section provided in a sheet conveying path, which connects between the position of the sheet storing section and the position where the thermal head is arranged, and configured to detect a label position of the label sheet, the printer including a control section and a storing section, and the method including: an information storing section storing a position of the label sheet detected by the label-position detecting section when the power supply is turned off in the nonvolatile storage section as stop position information; and a position setting section setting the stop position information, which is stored in the nonvolatile storage section, as a print start position for printing by the thermal head, the storing a position of the label sheet and the setting the stop position information being executed by the control section.

DETAILED DESCRIPTION

Exemplary embodiments of the present invention are explained in detail below with reference to the accompanying drawings.

In an embodiment of the present invention, a printer is a thermal portable printer that stores in the inside thereof a sheet roll formed by winding a label sheet, on a base sheet plural labels of which are stuck, and performs printing with a thermal head.

Figure 1:
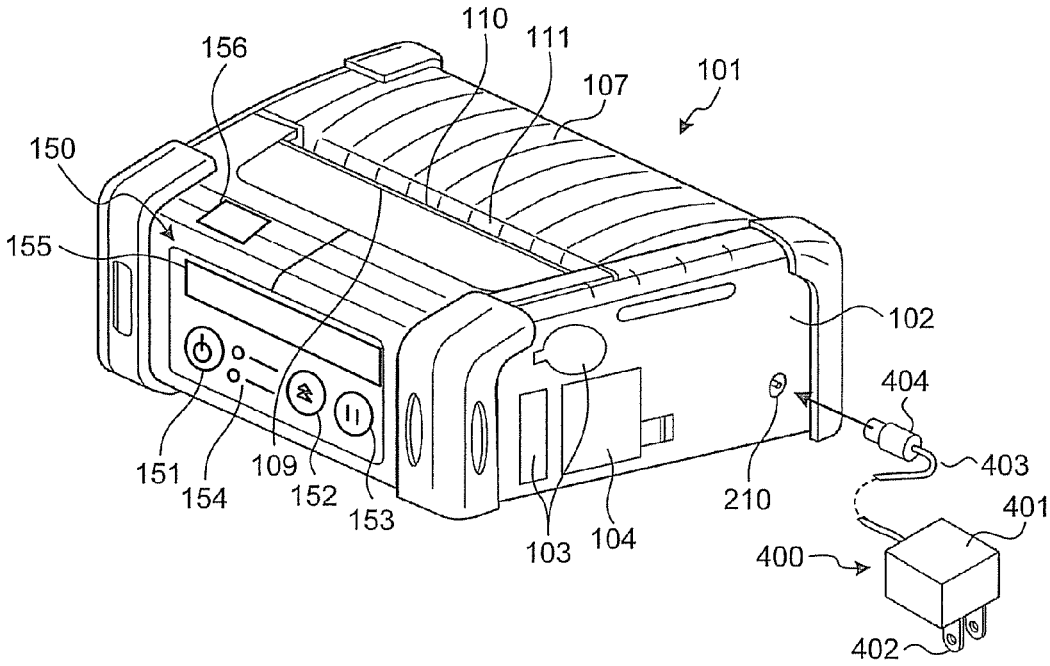
FIG. 1 is a perspective view of an external appearance of a portable printer according to an embodiment of the present invention.
Figure 2:
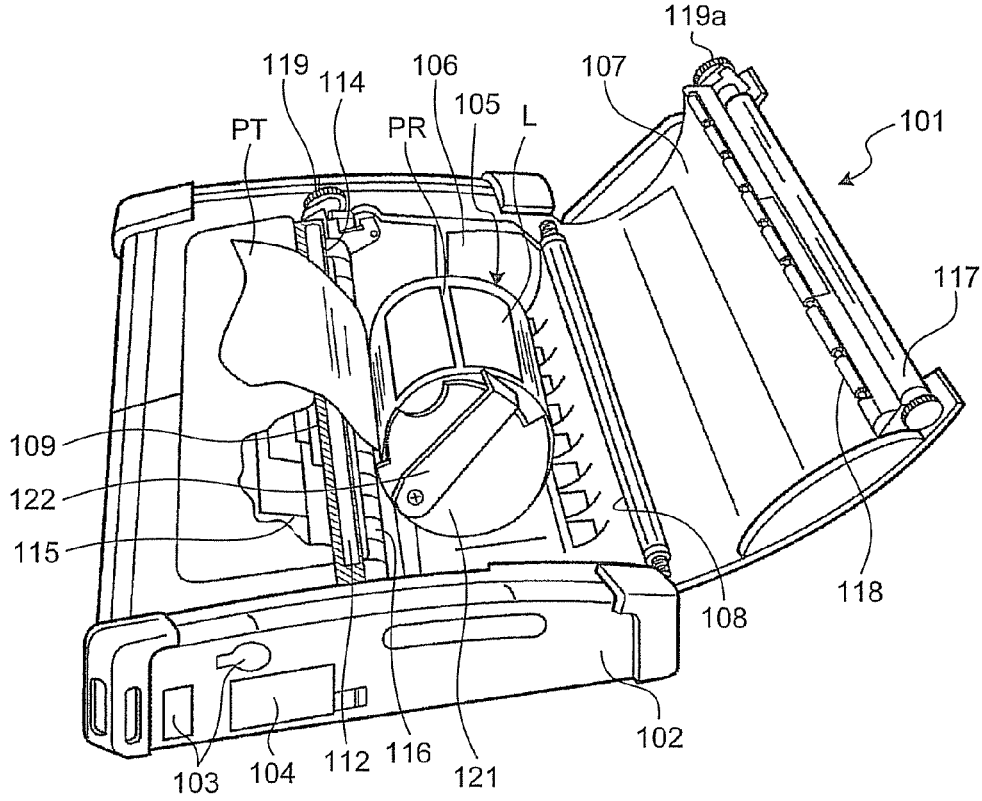
FIG. 2 is a perspective view of an external appearance of the portable printer with a cover thereof opened.

The schematic structure of a portable printer 101 is explained below. FIG. 1 is a perspective view of an external appearance of the portable printer according to this embodiment. FIG. 2 is a perspective view of an external appearance of the portable printer with a cover thereof opened.

The portable printer 101 has a rectangular parallelepiped external shape. In the portable printer 101, a printing mechanism 300 (see FIG. 4) configured to perform a printing function and a sheet feeding function and a rechargeable battery 270 (see FIG. 4) as a power supply are housed in a housing 102. The rechargeable battery 270 is a lithium ion rechargeable battery. The housing 102 stores a sheet roll PR formed by winding a label sheet PT, on a base sheet plural labels L (see FIG. 2) of which are stuck. The housing 102 includes an opening 106 in the upper surface thereof such that the sheet roll PR can be led into the inside thereof. The opening 106 pivotally includes a cover 107. The opening 106 changes to an opened state or a closed state according to opening or closing of the cover 107.

The housing 102 includes a cover opening and closing sensor 50 (see FIG. 4) as a cover opening and closing detecting section configured to detect the opened state and the closed state of the cover 107. The cover opening and closing sensor 50 is a micro switch as a mechanical sensor. In a state in which the cover 107 is released from the housing 102 and the opening 106 is opened, the cover opening and closing sensor 50 changes to an OFF state in which an electric current does not flow. On the other hand, in a state in which the cover 107 covers the opening 106, the cover opening and closing sensor 50 changes to an ON state in which an electric current flows. The cover opening and closing sensor 50 is not limited to the micro switch. For example, a non-contact switch including an optical sensor can also be used.

The cover 107 is attached to an inner side edge 108 of the housing 102 that forms one side of the opening 106. The cover 107 forms, in the closed state, an elongated gap for taking out a printed label sheet PT in the width direction of the portable printer 101 between an outer side edge 111, which is a leading end of the cover 107, and a front side edge 109, which is one side of the opening 106. The gap functions as a sheet discharge port 110.

One side surface of the housing 102 includes a connection connector section 103 configured to have various connectors and a battery housing section 104 configured to detachably house the rechargeable battery 270.

The front side edge 109 of the housing 102 and the outer side edge 111 of the cover 107, which form the sheet discharge port 110, are formed in a sharp shape. The front side edge 109 and the outer side edge 111 of the cover 107 are used for cutting the label sheet PT discharged from the sheet discharge port 110.

The housing 102 includes a sheet storing section 105 configured to be capable of detachably storing the sheet roll PR. The sheet storing section 105 stores the sheet roll PR with a roll axis directed in the width direction of the portable printer 101. A platen 117 conveys the label sheet PT of the sheet roll PR to the sheet discharge port 110 (see FIG. 1) while drawing out the label sheet PT. The platen 117 is arranged to be opposed to a thermal head 112.

A head bracket 115 fixed to the housing 102 urges the thermal head 112 upward to the inner side of the portable printer 101. The thermal head 112 is attached to and detached from the head bracket 115. A head cover 116 is adjacent to the thermal head 112 on the inner side of the portable printer 101. The head cover 116 is attached to the housing 102 when necessary and urges the thermal head 112 to prevent vibration of the thermal head 112.

In the thermal head 112, an array of plural heat generating elements 114 is arranged in a row at predetermined density. The heat generating element array 114 generates heat based on the control by a head control device 133 (see FIG. 4), whereby the thermal head 112 heats the label L of the label sheet PT and performs printing. As the thermal head 112 detachably attachable to the head bracket 115, for example, a 203 dpi thermal head and a 300 dpi thermal head are selectively arranged.

The housing 102 includes a driving gear 119. The driving gear 119 is driven to rotate by a stepping motor 131 (see FIG. 4) that is controlled to be driven by a motor control device 134 (see FIG. 4).

The cover 107 includes a sheet pressing roller 118 near the platen 117. Both the platen 117 and the sheet pressing roller 118 rotate with rotation axes directed to the width direction of the portable printer 101.

The cover 107 includes the platen 117. The platen 117 is aligned in a position in contact with the heat generating element array 114 of the thermal head 112 when the cover 107 is closed. A driven gear **119*a* configured to rotate integrally with the platen 117 is connected to the left side of the platen 117 when viewed from the front side of the portable printer 101**.

When the cover 107 is closed, the driven gear **119*a* meshes with the driving gear 119 and is driven by the driving gear 119. The sheet pressing roller 118 is connected to the cover 107 to be aligned in a position in contact with the head cover 116 when the cover 107 is closed. When the cover 107 is closed, the driven gear 119*a* attached to the cover 107 meshes with the driving gear 119 and drives to rotate the platen 117 coupled to the driven gear 119*a*. In this embodiment, the driving gear 119 and the driven gear 119*a* configure a change gear 132 (see FIG. 4**).

The sheet roll PR is attached to or detached from the sheet storing section 105 by a lever 122. The sheet roll PR is arranged between two guide fences 121. A space between the two guide fences 121 can be changed according to the width of the sheet roll PR.

Figure 3:
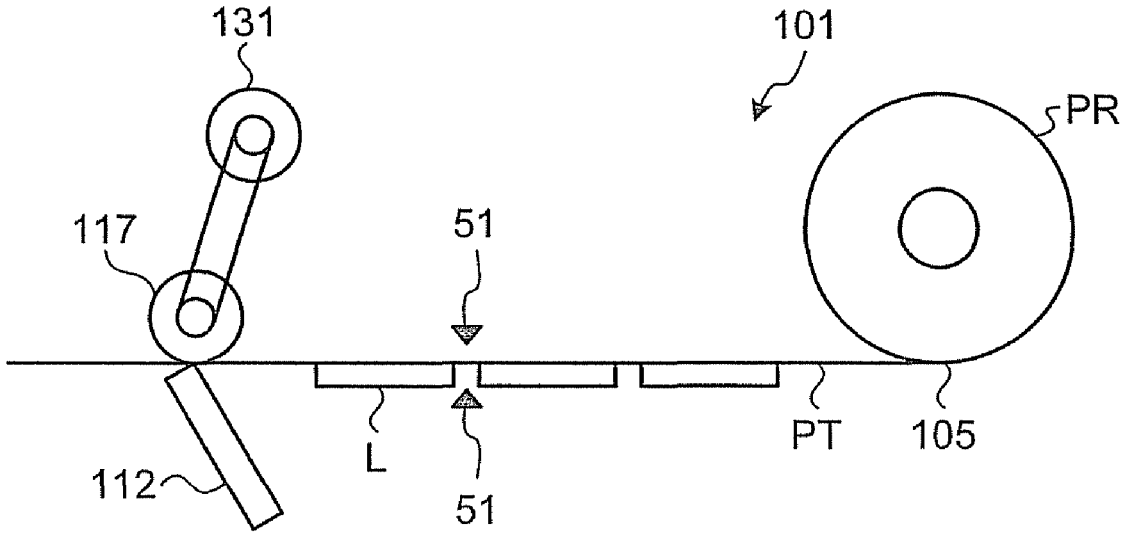
FIG. 3 is a schematic diagram of a sheet conveying path.

As shown in FIG. 3, the portable printer 101 includes, in a sheet conveying path that connects between the position of the sheet storing section 105 and the position where the thermal head 112 is arranged, a label sensor 51 as a label-position detecting section configured to detect the position of the label L stuck to the base sheet of the label sheet PT. More specifically, the label sensor 51 may be a transmissive sensor for detecting a gap between the labels L stuck to the base sheet of the label sheet PT or may be a reflective sensor for detecting the label L stuck to the base sheet of the label sheet PT.

The portable printer 101 includes, in the housing 102, a DC-power input section 210 to which DC power is supplied from an external power supply. A plug 404 of an AC adapter 400 is inserted into the DC-power input section 210 and the DC power is supplied to the portable printer 101.

The AC adapter 400 is formed separately from the portable printer 101. The AC adapter 400 is inserted into a commercial power outlet on the outside and outputs the DC power. The AC adapter 400 includes a main body 401 including a DC conversion circuit, an outlet plug 402 attached to the main body 401, a cable 403 for DC power output, and a plug 404. The AC adapter 400 outputs AC 100 V power, which is input from the outlet plug 402, to the plug 404 at the tip of the cable 403 as DC 20 V power.

As a device configured to supply the DC power from the DC-power input section 210, besides a general-purpose AC adapter, a car adapter (with input and output of 12V), a DC-DC converter (with input of 10 to 60 V and output of 20 V), and the like can be used.

The plug 404 is connected to the DC-power input section 210, whereby the DC power is supplied to the portable printer 101 and the rechargeable battery 270 can be charged.

In addition, the portable printer 101 includes an operation unit 150 in the housing 102. The operation unit 150 includes a power switch 151, a paper feed button 152 as a paper-feed instructing section with which a user instructs paper feed, a halt button 153 with which the user instruct a halt of the paper feed, an indicator 154 for alerting the user to a charging state of the rechargeable battery 270, a liquid crystal display (LCD) 155, and a communication window 156. Schematically, the portable printer 101 can execute data transmission and reception through infrared communication or the like performed via the communication window 156 and a communication interface 140 (see FIG. 5). By executing such data transmission and reception, the portable printer 101 receives, for example, print data and accumulates the print data in a random access memory (RAM) 13 and a flash memory 14 (see FIG. 5).

Figure 4:
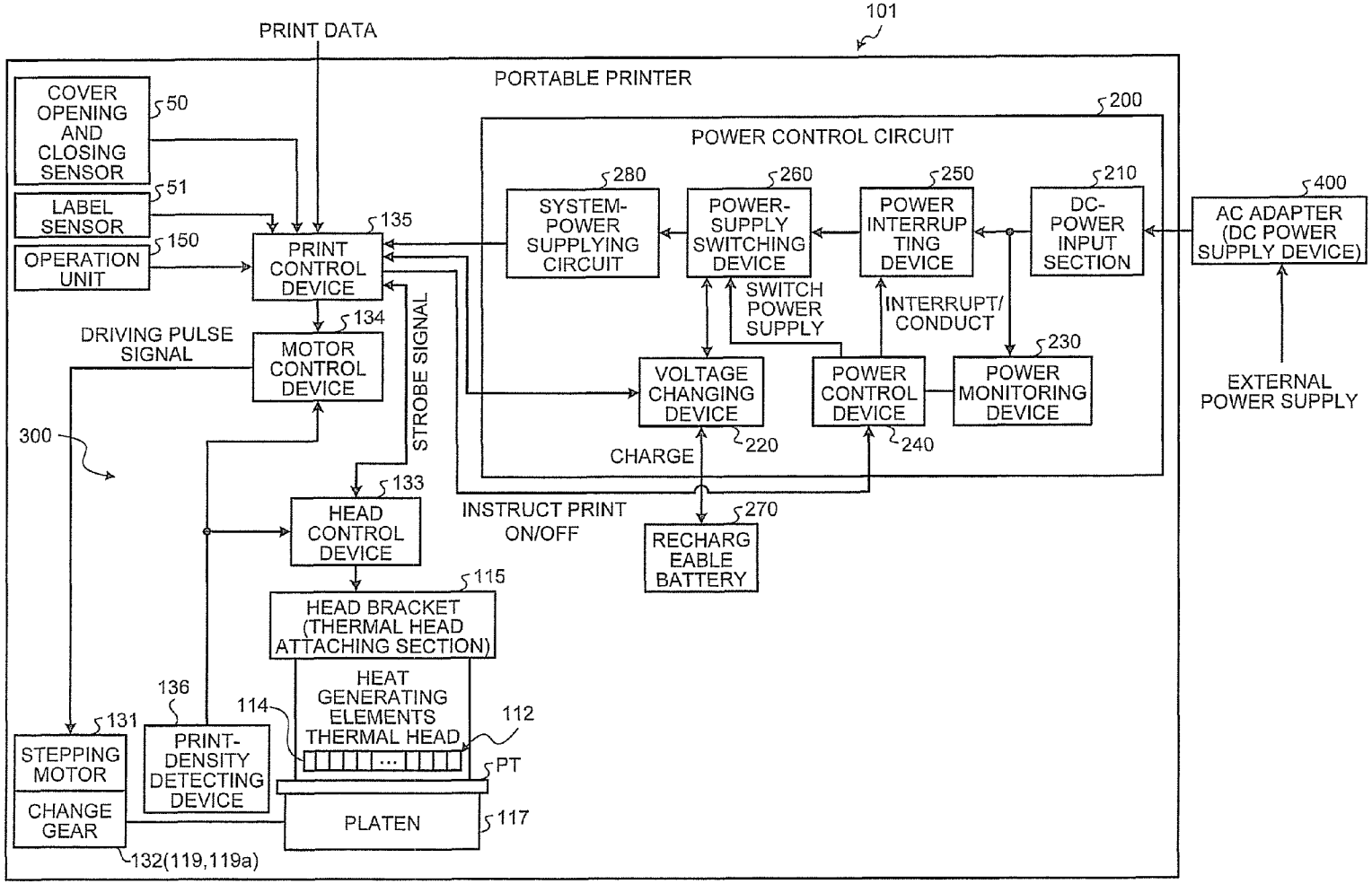
FIG. 4 is a block diagram of a control system for the portable printer.

A control system for the portable printer 101 is explained below. FIG. 4 is a block diagram of the control system for the portable printer 101.

As shown in FIG. 4, the printing mechanism 300 of the portable printer 101 includes a head control device 133 configured to output print control signals including a strobe signal and a print signal to the thermal head 112 and a motor control device 134 configured to output a driving pulse signal to the stepping motor 131. The print control device 135 controls the entire apparatus including the cover opening and closing sensor 50, the label sensor 51, the operation unit 150, and the printing mechanism 300.

The printing mechanism 300 of the portable printer 101 includes a print-density detecting device 136 configured to detect whether the thermal head 112 attached to the head bracket 115 is a 300 dpi thermal head or a 203 dpi thermal head.

Figure 5:
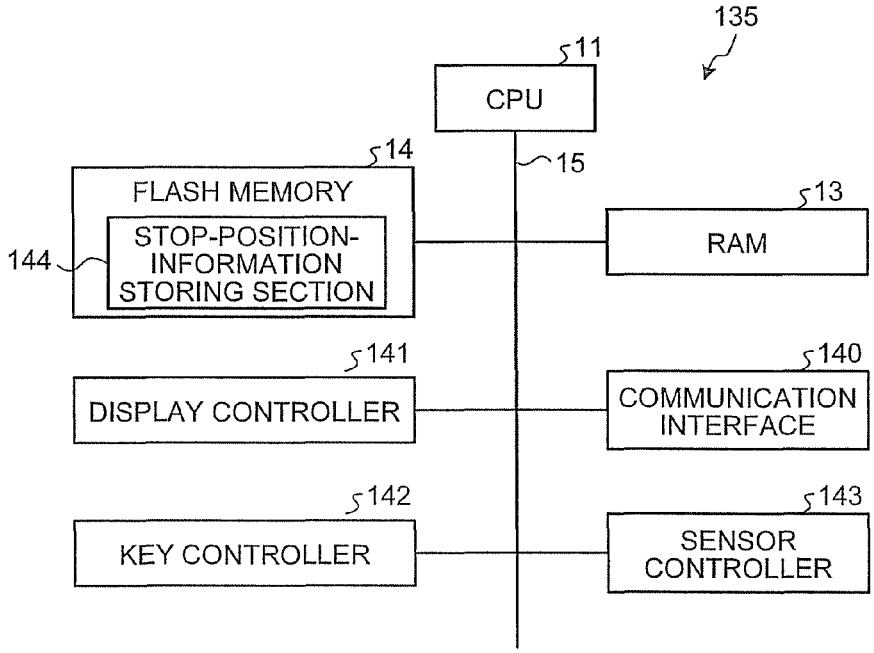
FIG. 5 is a block diagram of the configuration of a print control device.

FIG. 5 is a block diagram of the configuration of the print control device 135. As shown in FIG. 5, the print control device 135 includes a central processing unit (CPU) 11 configured to execute various kinds of arithmetic processing and centrally control sections of the print control device 135. The random access memory (RAM) 13 and the flash memory 14 as a nonvolatile storage section configured to be capable of keeping stored content even if a power supply is turned off are connected to the CPU 11 via a system bus 15.

The flash memory 14 stores an operation program and various kinds of setting information for the portable printer 101. The CPU 11 copies the operation program stored in the flash memory 14 to the RAM 13 and executes the operation program to thereby control the sections. The operation program also includes a computer program for performing power-off processing and power-on processing explained later. In addition, the flash memory 14 includes a stop-position-information storing section 144 for storing stop position information of the label sheet PT used in the power-off processing and the power-on processing.

The RAM 13 temporarily stores various kinds of variable information. A part of an area of the RAM 13 is used as a print buffer in which print data (image data) printed on the label L of the label sheet PT is expanded. The print data is data as a print target received from a host computer (not shown). The print data may be data stored in the flash memory 14. The host computer is, for example, a personal computer (PC), a cellular phone, or a handy terminal. The host computer executes various kinds of arithmetic processing according to operation input by the user.

The communication interface 140, a display controller 141, a key controller 142, and a sensor controller 143 are connected to the CPU 11 via the system bus 15. The display controller 141 controls, under the control by the CPU 11, display (battery power, a radio wave reception state, an error message, etc.) on the LCD 155 of the operation unit 150. The key controller 142 controls, under the control by the CPU 11, key inputs from the power switch 151, the paper feed button 152, and the halt button 153 of the operation unit 150. The sensor controller 143 controls, under the control by the CPU 11, inputs from sensors such as the cover opening and closing sensor 50 and the label sensor 51.

The communication interface 140 is an interface for performing communication with an external apparatus such as the host computer. The communication interface 140 includes infrared communication such as IrDA, a universal serial bus (USB), a wireless local area network (LAN), RS-232C, or Bluetooth (registered trademark). The communication interface 140 communicates with a communication interface provided in the host computer.

The portable printer 101 includes a power control circuit 200 in the housing 102. The power control circuit 200 controls, in terms of software, supply and interruption of electric power from the external commercial power outlet via an AC adapter 400 or the like or electric power from the rechargeable battery 270 according to ON and OFF of the power switch 151 of the operation unit 150. "In terms of software" means that supply and interruption of electric power are controlled by a control signal of the portable printer 101.

The power control circuit 200 includes the DC-power input section 210, a voltage changing device 220, a power monitoring device 230, a power control device 240, a power interrupting device 250, a power-supply switching device 260, a system-power supplying circuit 280 as a power supplying device.

The voltage changing device 220 changes the voltage of DC power in a predetermined voltage range (e.g., 10 V to 25 V) input from the DC-power input section 210 to voltage (e.g., 8.4 V or 16.8 V: depending on specifications of a rechargeable battery) suitable for charging of the rechargeable battery 270. In this embodiment, since the rechargeable battery 270 is a lithium ion rechargeable battery, a CC/CV charging system is adopted, i.e., external DC voltage is dropped to perform charging with fixed current and voltage.

In charging, the voltage changing device 220 can set the rechargeable battery 270 in a long life mode, in which the life of a battery can be extended, by setting charging voltage and current variable or adjusting a threshold for recharging. The power monitoring device 230 monitors the voltage of the DC power from the DC-power input section 210. When the voltage of the DC power detected by the power monitoring device 230 deviates from the predetermined range (10 V to 25 V), the power interrupting device 250 interrupts the DC power from the DC-power input section 210. The power-supply switching device 260 switches driving power supplied to the printing mechanism 300 to one of the electric power from the DC-power input section 210 and the electric power from the rechargeable battery 270.

The power control device 240 applies control explained below to the power interrupting device 250 and the power-supply switching device 260.

First, if the DC power from the DC-power input section 210 is in the predetermined range (10 V to 25 V) according to a detection result of the power monitoring device 230, the power control device 240 supplies charging DC power (8.4 V) from the voltage changing device 220 to the rechargeable battery 270 by causing the power-supply switching device 260 to operate and causing the DC power from the DC-power input section 210 to conduct to the voltage changing device 220. In this state, the electric power from the DC-power input section 210 is also supplied to the system-power supplying circuit 280.

When the power control device 240 receives a print signal from the print control device 135 in a state in which the DC power is supplied to the DC-power input section 210 from the outside, the power control device 240 actuates the power-supply switching device 260 and sets the driving power of the printing mechanism 300 as electric power for the rechargeable battery 270. In other words, when a print instruction is received, the electric power from the DC-power input section 210 to the printing mechanism 300 is interrupted. However, the electric power to the print control device 135 is supplied from the DC-power input section 210 if the voltage from the DC-power input section 210 is in the predetermined range.

Further, even when no print instruction is received, the power control device 240 drives the power-supply switching device 260 and supplies the electric power to the system-power supplying circuit 280 from the rechargeable battery 270 when the voltage of the DC power detected by the power monitoring device 230 is lower than the voltage of the rechargeable battery 270.

The system-power supplying circuit 280 supplies the electric power to the sections of the printing mechanism 300 via the print control device 135. The system-power supplying circuit 280 applies the electric power in a range of allowable voltage to the thermal head 112 of the printing mechanism 300. Specifically, when the portable printer 101 performs printing, the power supply from the DC-power input section 210 is interrupted by the power interrupting device 250 and the electric power from the rechargeable battery 270 is supplied by the power-supply switching device 260. Therefore, voltage exceeding the allowable voltage of the thermal head 112 is not supplied.

The system-power supplying circuit 280 supplies electric power (with voltage of 5 V, 3.3 V, 1.5V, etc.) for driving the print control device 135. In this way, in the system-power supplying circuit 280, operation input voltages to the sections are set such that the sections can properly operate in the ranges of the voltages of the external DC power and the rechargeable battery 270.

The system-power supplying circuit 280 performs control of ON and OFF of the power supply systems driven by the DC power from the rechargeable battery 270 and the DC-power input section 210. Specifically, the system-power supplying circuit 280 supplies the DC power from the DC-power input section 210 to the print control device 135 when the DC power is supplied to the DC-power input section 210. The system-power supplying circuit 280 supplies the DC power from the rechargeable battery 270 to the print control device 135 when the DC power is not supplied to the DC-power input section 210.

When the DC power from the rechargeable battery 270 is supplied to the print control device 135 by the power control device 240, the system-power supplying circuit 280 supplies the DC power to the printing mechanism 300 through the print control device 135.

Besides performing the control of the printing mechanism 300, when power supply is performed, the print control device 135 acquires information from the voltage changing device 220 and the system-power supplying circuit 280. When the voltage changing device 220 and the system-power supplying circuit 280 are under rechargeable conditions, the print control device 135 sends an instruction for starting charging to the power control device 240.

The print control device 135 sets the portable printer 101 in various state modes according to situations. As the modes, a standby mode in which printing by the thermal head 112 is immediately performed, a sleep mode in which a system for reducing power consumption is set in an energy saving state, a printing mode in which printing is performed by the thermal head 112, a charging mode in which the rechargeable battery 270 is charged, and a long-life charging mode in which charging is performed at low voltage for not reducing the life of the rechargeable battery 270 are set.

In such a portable printer 101, when the sheet roll PR is stored in the sheet storing section 105, the label sheet PT is drawn out, and the cover 107 is closed, the drawn-out label sheet PT is held between the thermal head 112 and the platen 117 and held between the head cover 116 and the sheet pressing roller 118. When the portable printer 101 is set in the printing mode under the control by the print control device 135 in this state, the motor control device 134 drives the stepping motor 131. According to the driving of the stepping motor 131, the portable printer 101 conveys the label sheet PT from the sheet roll PR in a direction toward the sheet discharge port 110 through the thermal head 112. The portable printer 101 set in the printing mode prints predetermined content on the label L of the conveyed label sheet PT by causing, based on the control by the head control device 133, the heat generating element array 114 of the thermal head 112 to generate heat.

The power-off processing and the power-on processing executed by the CPU 11 according to the computer program stored in the flash memory 14 are explained below with reference to a functional block diagram of FIG. 6 and flowcharts of FIGS. 7 and 8.

Figure 6:
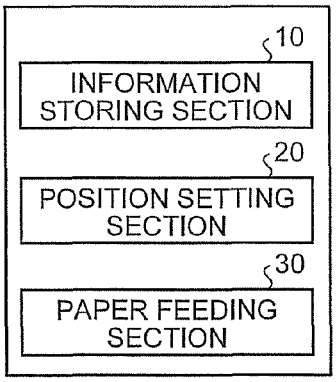
FIG. 6 is a functional block diagram of functions for power-off processing and power-on processing.

The computer program executed by the portable printer 101 according to this embodiment has a module configuration including sections (an information storing section 10, a position setting section 20, and a paper feeding section 30) shown in FIG. 6. As actual hardware, the CPU 11 reads out the computer program from the flash memory 14 and executes the computer program, whereby the sections are loaded onto the RAM 13 and the sections (the information storing section 10, the position setting section 20, and the paper feeding section 30) are generated on the RAM 13.

Figure 7:
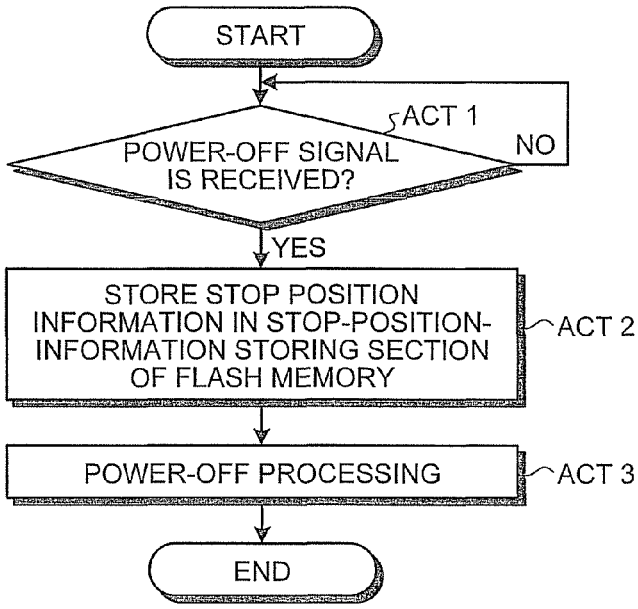
FIG. 7 is a flowchart for explaining a flow of the power-off processing.

As shown in FIG. 7, the information storing section 10 receives a power-off signal by the operation of the power switch 151 of the operation unit 150 (Yes in Act 1). After storing stop position information of the label sheet PT (the number of pulses from the label sensor 51) in the stop-position-information storing section 144 of the flash memory 14 (Act 2), the information storing section 10 executes the power-off processing (Act 3).

Figure 8:
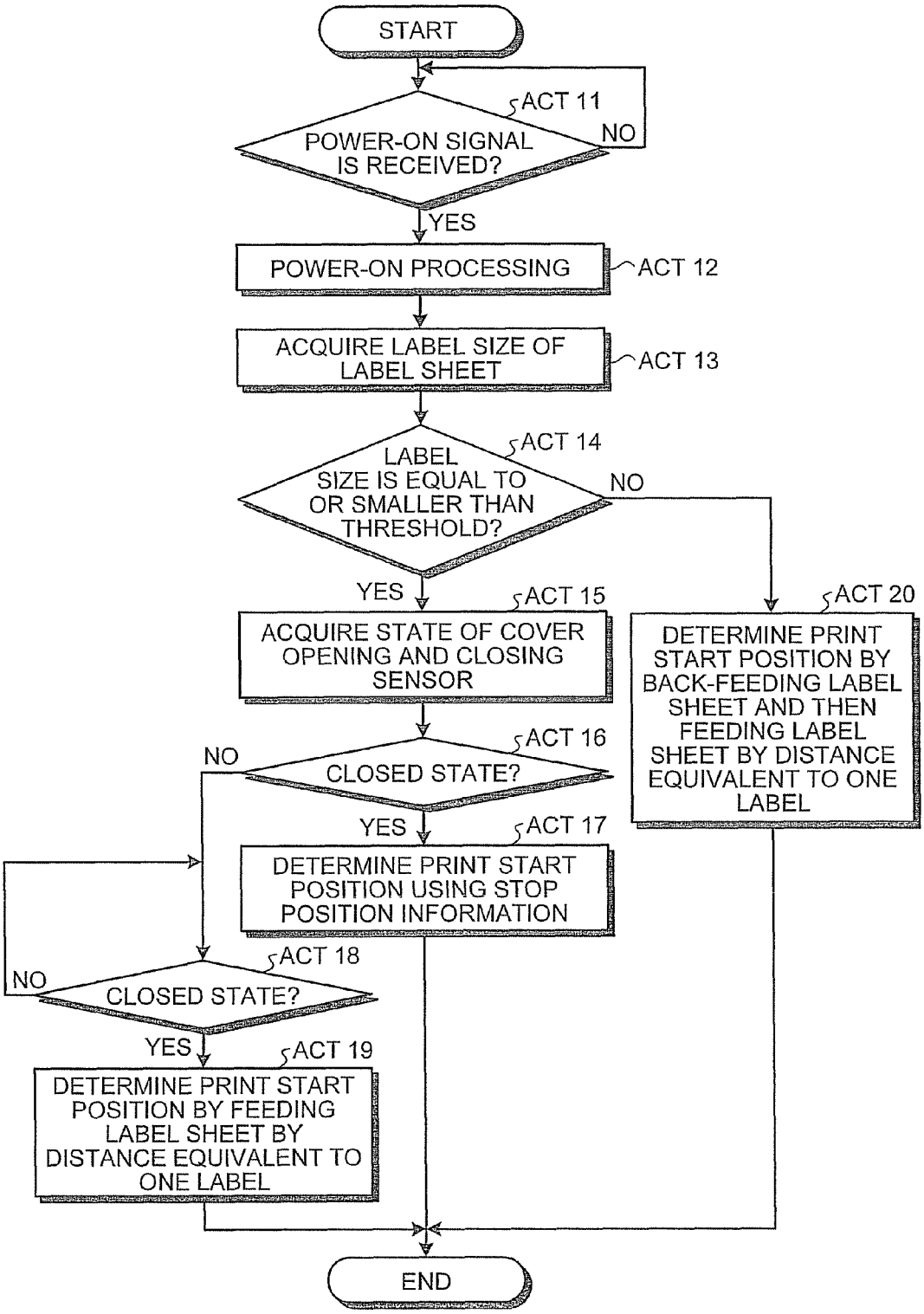
FIG. 8 is a flowchart for explaining a flow of the power-on processing.

On the other hand, as shown in FIG. 8, the position setting section 20 receives a power-on signal by the operation of the power switch 151 of the operation unit 150 (Yes in Act 11). The position setting section 20 executes the power-on processing (Act 12) and acquires a label size (the length of the short side of the label) of the label sheet PT from the various kinds of setting information stored in the flash memory 14 (Act 13). The label size (the length of the short side of the label) of the label sheet PT is registered in advance. In other words, the flash memory 14 also functions as a label-size storing section.

If the label size (the length of the short side of the label) of the label sheet PT is equal to or smaller than a threshold (Yes in Act 14), the position setting section 20 acquires a state of the cover opening and closing sensor 50 (Act 15) and determines an opened or closed state of the cover 107 (Act 16).

If the cover 107 is in the closed state (Yes in Act 16), the position setting section 20 determines a print start position using the stop position information of the label sheet PT (the number of pulses from the label sensor 51) stored in the stop-position-information storing section 144 of the flash memory 14 (Act 17).

If the cover 107 is in the opened state (No in Act 16), after the cover 107 changes to the closed state (Yes in Act 18), the position setting section 20 determines a print start position by feeding the label sheet PT by a distance equivalent to one label L by controlling the motor control device 134 (Act 19).

On the other hand, if the label size (the length of the short side of the label) of the label sheet PT is larger than the threshold (No in Act 14), since a jam is less likely to occur, the position setting section 20 determines a print start position by back-feeding the label sheet PT and feeding the label sheet PT by the distance equivalent to one label by controlling the motor control device 134 (Act 20).

After the print start position is determined as explained above, when a paper feed instruction signal by the operation of the paper feed button 152 of the operation unit 150 is received, the paper feeding section 30 feeds the label sheet PT by an instructed distance of the instruction signal by controlling the motor control device 134 irrespectively of the determined print start position.

As explained above, according to this embodiment, the position of the label sheet PT at the time when the poser supply is turned off, which is detected by the label sensor 51 provided in the sheet conveying path that connects the sheet storing section 105 and the thermal head 112, is stored as the stop position information in the stop-position-information storing section 144 that can keep stored content even if the power supply is turned off. When the power supply is turned on, the stop position information stored in the stop-position-information storing section 144 is set as the print start position for printing by the thermal head 112. Consequently, for example, when the label sheet PT is not replaced before and after the power supply is turned off and on, the stop position information stored in the stop-position-information storing section 144 can be set as the print start position for printing by the thermal head 112. Therefore, there is an effect that the labels L stuck to the base sheet of the label sheet PT are not wasted when a print start position is determined compared with the portable printer in the past that always feeds the label sheet PT by the distance equivalent to one label in order to determine a print start position.

If the label size (the length of the short side of the label L) of the label sheet PT is equal to or smaller than the threshold, the stop position information stored in the stop-position-information storing section 144 is set as a print start position for printing by the thermal head 112. If the label size is not equal to or smaller than the threshold, a print start position is determined by back-feeding the label sheet PT and then feeding the label sheet PT by the distance equivalent to one label. This is because, although the label L peels off the base sheet according to the back-feed and a jam occurs when the length of the short side of the label L stuck to the base sheet of the label sheet PT is small, a jam does not occur even if the label sheet PT is back-fed and then fed by the distance equivalent to one label when the length of the short side of the label L is sufficiently large.

If it is detected that the cover 107 is in the closed state, the stop position information stored in the stop-position-information storing section 144 is set as a print start position. If it is detected that the cover 107 is in the opened state, after it is detected that the cover 107 is in the closed state, a print start position is determined by feeding the label sheet PT by the distance equivalent to one label. This is because, if the cover 107 is in the opened state, replacement work for the label sheet PT is considered to be performed and the stop position information stored in the stop-position-information storing section 144 concerning the label sheet PT before the replacement work for the label sheet PT is useless.

The computer program executed by the portable printer 101 according to this embodiment is explained as being provided while being incorporated in the flash memory 14 in advance. However, the present invention is not limited to this. The computer program executed by the portable printer 101 according to this embodiment may be provided while being recorded in a computer-readable recording medium such as a CD-ROM, a flexible disk (FD), a CD-R, or a digital versatile disk (DVD) as a file in an installable or executable format.

The computer program executed by the portable printer 101 according to this embodiment may be stored in a computer connected to a network such as the Internet and provided by being downloaded through the network. The computer program executed by the portable printer 101 according to this embodiment may be presented or distributed through the network such as the Internet.

Further effects and modifications can be easily derived by those skilled in the art. Therefore, a wider aspect of the present invention is not limited by the specific details and the representative embodiment represented and described above. Therefore, various modifications are possible without departing from the spirit or the scope of the general concept of the invention defined by the appended claims and their equivalents.

What is claimed is:

1. A printer comprising:

a nonvolatile storage section configured to be capable of keeping stored content even if a power supply is turned off;

a sheet storing section configured to store a label sheet wound in a roll shape;

a thermal head configured to heat a label stuck to a base sheet of the label sheet and perform printing in a process in which the label sheet, which is stored in the sheet storing section, is drawn out and conveyed in a sub-scanning direction by using a motor as a driving source;

a label-position detecting section provided in a sheet conveying path, which connects between the position of the sheet storing section and the position where the thermal head is arranged, and configured to detect a label position of the label sheet;

an information storing section configured to store a position of the label sheet detected by the label-position detecting section when the power supply is turned off in the nonvolatile storage section as stop position information; and a position setting section configured to set the stop position information, which is stored in the nonvolatile storage section, as a print start position for printing by the thermal head.

2. The printer according to claim 1, further comprising a label-size storing section configured to store a label size of the label sheet, wherein the position setting section sets, if the label size stored in the label-size storing section is equal to or smaller than a predetermined size, the stop position information stored in the nonvolatile storage section as the print start position for printing by the thermal head.

3. The printer according to claim 1, further comprising a cover opening and closing detecting section configured to detect opened and closed states of a cover for opening or closing at least a part of the sheet storing section to and from an outside, wherein the position setting section sets, if the cover opening and closing detecting section detects that the cover is in the closed state, the stop position information stored in the nonvolatile storage section as the print start position for printing by the thermal head.

4. The printer according to claim 3, wherein the position setting section determines, if the cover opening and closing detecting section detects that the cover is in the opened state, a print start position by feeding the label sheet by driving the motor after the cover opening and closing detecting section detects that the cover is in the closed state.

5. The printer according to claim 2, wherein the position setting section determines, if the label size stored in the label-size storing section is not equal to or smaller than a threshold, a print start position by back-feeding the label sheet and then feeding the label sheet by driving the motor.

6. The printer according to claim 1, further comprising:

a paper-feed instructing section configured to instruct feeding of the label sheet by driving the motor; and a paper feeding section configured to feed, after the position setting section determines the print start position, when a paper feed instruction is received from the paper-feed instructing section, the label sheet by an instructed distance by driving the motor irrespectively of the print start position determined by the position setting section.

7. A method of determining a print start position executed by a printer including: a nonvolatile storage section configured to be capable of keeping stored content even if a power supply is turned off; a sheet storing section configured to store a label sheet wound in a roll shape; a thermal head configured to heat a label stuck to a base sheet of the label sheet and perform printing in a process in which the label sheet, which is stored in the sheet storing section, is drawn out and conveyed in a sub-scanning direction by using a motor as a driving source; and a label-position detecting section provided in a sheet conveying path, which connects between the position of the sheet storing section and the position where the thermal head is arranged, and configured to detect a label position of the label sheet, the printer including a control section and a storing section, and the method comprising:

an information storing section storing a position of the label sheet detected by the label-position detecting section when the power supply is turned off in the nonvolatile storage section as stop position information; and a position setting section setting the stop position information, which is stored in the nonvolatile storage section, as a print start position for printing by the thermal head, the storing a position of the label sheet and the setting the stop position information being executed by the control section.

8. The method according to claim 7, wherein the printer further includes a label-size storing section configured to store a label size of the label sheet, and the position setting section sets, if the label size stored in the label-size storing section is equal to or smaller than a predetermined size, the stop position information stored in the nonvolatile storage section as the print start position for printing by the thermal head.

9. The method according to claim 7, wherein the printer further includes a cover opening and closing detecting section configured to detect opened and closed states of a cover for opening or closing at least a part of the sheet storing section to and from an outside, and the position setting section sets, if the cover opening and closing detecting section detects that the cover is in the closed state, the stop position information stored in the nonvolatile storage section as the print start position for printing by the thermal head.

10. The method according to claim 9, wherein the position setting section determines, if the cover opening and closing detecting section detects that the cover is in the opened state, a print start position by feeding the label sheet by driving the motor after the cover opening and closing detecting section detects that the cover is in the closed state.

11. The method according to claim 8, wherein the position setting section determines, if the label size stored in the label-size storing section is not equal to or smaller than a threshold, a print start position by back-feeding the label sheet and then feeding the label sheet by driving the motor.

* * * * *